US009062923B1

(12) United States Patent
Thorup

(10) Patent No.: US 9,062,923 B1
(45) Date of Patent: Jun. 23, 2015

(54) FIREARM COMPONENTS

(71) Applicant: Richard Terry Thorup, Ocean Isle Beach, NC (US)

(72) Inventor: Richard Terry Thorup, Ocean Isle Beach, NC (US)

(73) Assignee: Richard Terry Thorup, Ocean Isle Beach, NC (US)

( * ) Notice: Subject to any disclaimer, the term of this patent is extended or adjusted under 35 U.S.C. 154(b) by 0 days.

(21) Appl. No.: 14/277,535

(22) Filed: May 14, 2014

(51) Int. Cl.
*F41C 23/00* (2006.01)
*F41A 3/64* (2006.01)

(52) U.S. Cl.
CPC .. *F41A 3/64* (2013.01); *F41C 23/00* (2013.01)

(58) Field of Classification Search
USPC ..... 42/71.01, 75.03, 75.01; 224/150
See application file for complete search history.

(56) References Cited

U.S. PATENT DOCUMENTS

| | | | | |
|---|---|---|---|---|
| 6,662,485 | B2 | 12/2003 | Kay | |
| 6,715,781 | B1 * | 4/2004 | Smith | 280/416.1 |
| 2012/0240441 | A1 * | 9/2012 | Cottle | 42/71.01 |
| 2012/0311907 | A1 * | 12/2012 | Cottle | 42/71.01 |
| 2013/0091751 | A1 | 4/2013 | Barney | |

OTHER PUBLICATIONS

Krebs Custom online catalogue: www.Krebscustom.com/ak-stocks.aspx : Item No. AKABVC adaptor for Russian imported VERP rifle buttstock adaptor (see the Krebbs-stocks.pdf, included in electronic filing).

* cited by examiner

*Primary Examiner* — Michael David
(74) *Attorney, Agent, or Firm* — Don Payne

(57) ABSTRACT

The invention relates to a system of parts for modifying and supporting a c-channel type firearm receiver. More specifically, the invention provides modifying members and subassemblies for Kalashnikov-type rifles having c-channel type receivers comprising separate internal & external support members that are adapted to be interconnected where the receiver is placed between and connected to the support members.

7 Claims, 9 Drawing Sheets

FIREARM COMPONENTS

CROSS-REFERENCE TO RELATED APPLICATIONS

There are no related applications.

FIELD OF THE INVENTION

The invention relates to systems of parts for modifying a firearm receiver and adapting the firearm to receive ergonomically correct firearm stock and hand-grip portions. More specifically, the invention provides modifying members to Kalashnikov-type rifles having "C"-channel type receivers, and for adapting tubular and/or telescopic stock portions thereto.

BACKGROUND

The development of modern long guns-type firearms (e.g. rifles) systems has spawned numerous accessories and devices for improving the integrity, and ease of firing, and the like, to obtain more accurate shooting results. In particular, firearm ergonomics, and construction, have advanced over the last half-century with the advent of rifles where a central component, the chassis or "receiver", is primarily metallic, is used as a bracket or backbone from which to attach the other components. Two of the fire arms which typify this type of construction include the so-called "AK-47" type rifle, initially manufactured by the old Soviet state (i.e. Russia); and the modern United States M4/M16/Armalite/AR series rifles. Both designs have been adapted to military and civilian usage due, in part, to modern construction and design.

The modern United States M4/M16/Armalite/AR series rifles are constructed around a cast and/or machined aluminum alloy backbone that allows for a direct linear recoil force to be transmitted to a shooter. This type of design is useful for returning subsequent shots and keeping on target as is well known in the shooting arts.

In contrast, most traditional types of rifles employ a dropped stock portion that transmits recoil forces in a somewhat angular, off axis fashion to the shooter. This ergonomic arrangement makes a second or follow-up shot to a target more difficult as the shooter often must re-aim the rifle. The so-called "AK-47"/Kalashnikov rifle ("AK") is of modern metal channel construction, and incorporates a traditional drop-style stock. The Kalashnikov rifle is popular with both military and civilian shooters due to its simplicity and low cost design, and the availability of inexpensive ammunition. These rifles are officially known in Russian as "Avtomat Kalashnikova" (Kalashnikov Automatic) but are widely known as "Kalashnikovs", "AKs", "AK-47", or in Russian slang, as a "Kalash" and the like. Originally, primarily, Izhmash manufactured them in the Soviet Union. These rifles, and their many variants, are now manufactured in many other countries, and by numerous companies including, but not limited to: Saiga, IMI Galil, and Arsenel, along with many others. Often, the AK type of rifle is constructed of a receiver fabricated from a sheet metal stamping having a bottom and sides, with various openings being pre-stamped or formed in the sheet prior to bending the sheet to the shape of a c-channel shaped receiver (or rifle chassis) to facilitate attachment of various rifle parts directly thereto (triggers, handgrips, stocks, barrel, guards, firing mechanism, top, ejection mechanism, etc.) These component parts are attached to the receiver by pins, clasps, screws, rivets, etc. through the standard system of slots and holes, etc. for ease of interchangeability. The standard AK C-channel receiver is universally known and a generic folded sheet metal form. But, this remarkable simplicity results in a number of shortcomings due to the aforementioned sheet metal structure and design of the receiver. AK-type rifles are often perceived as lacking the ability to shoot accurately, consistently, and retain their structural integrity over time. Accordingly, it would be useful to provide components that make use of standard AK-receivers to overcome and improve on these deficiencies without major modifications thereto. The present invention comprises parts and subassemblies to overcome some of the deficiencies in the AK- or other type firearms based around shell type fabricated c-channel receiver-based firearms.

SUMMARY OF THE INVENTION

The invention relates to components and combinations of components for improving and/or modifying a AK-47 or Kalashnikov rifle ("AK") type rifle, or other firearm incorporating a c-channel"-type firearm receiver.

In a first aspect of the invention, as disclosed below and shown in the appended Figures, there is provided an internal receiver support 100 as shown in FIGS. 1 and 2.

In a second aspect of the invention, there is provided an external receiver support in FIGS. 3 and 4, 200 wherein the internal support 100 and the external support 200 are adapted to be interconnected.

In a third aspect of the invention, there is provided a rifle sub-assembly according to FIGS. 5 and 6, comprising the internal receiver support, the external receiver support, according to the claimed invention, a conventional c-channel type firearm receiver as previously defined and described.

In a forth aspect of the invention, there is provided a rifle sub-assembly according to FIG. 6, comprising the internal receiver support and external receiver support, according to the claimed invention, a conventional, c-channel type firearm receiver as previously defined and described, a telescopic rifle stock mounted on the distal end of the internal support, a firearm hand grip mounted onto the external receiver support, a trigger guard mounted on the receiver bottom, and a conventional rifle barrel mounted in a standard configuration in the c-channel type firearm receiver, the barrel and opening in the external receiver being coaxial about the length of the subassembly.

In a fifth and sixth aspect of the invention, there is provided a variation on the first aspect of the invention, as disclosed below, and shown in the appended FIGS. 7 and 8 which are a variation on the internal receiver support 100 as shown in FIGS. 1 and 2 that fits into and onto the end and inside a standard c-channel type AK rifle receiver.

DETAILED DESCRIPTION

The invention relates to components and combinations of components for improving and/or modifying a AK-47 or Kalashnikov rifle ("AK") type rifle, or other similar firearm incorporating a c-channel type firearm receiver as defined previously.

Figure 1:
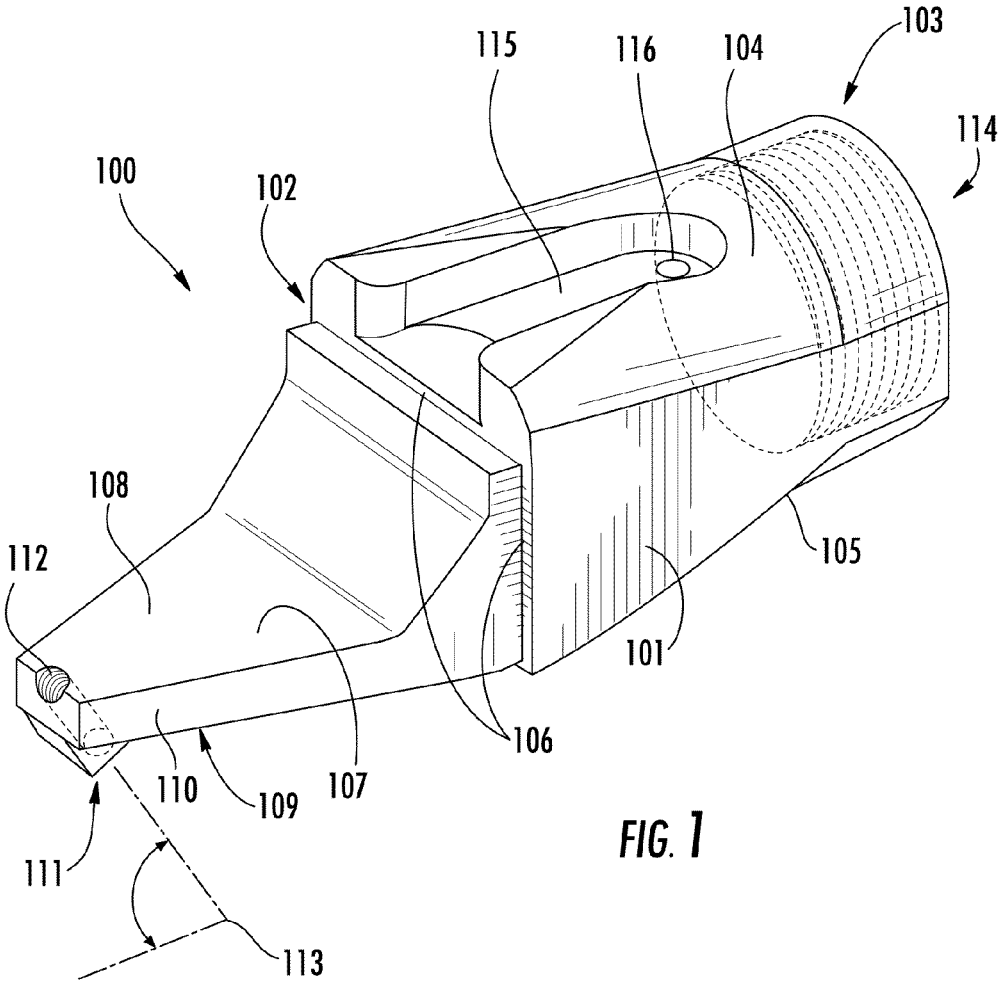
FIG. 1 (FIG. 1) is a perspective view of one embodiment of the internal receiver support according to the claimed invention that fits into and onto the end and inside a standard c-channel type AK rifle receiver.
Figure 2:
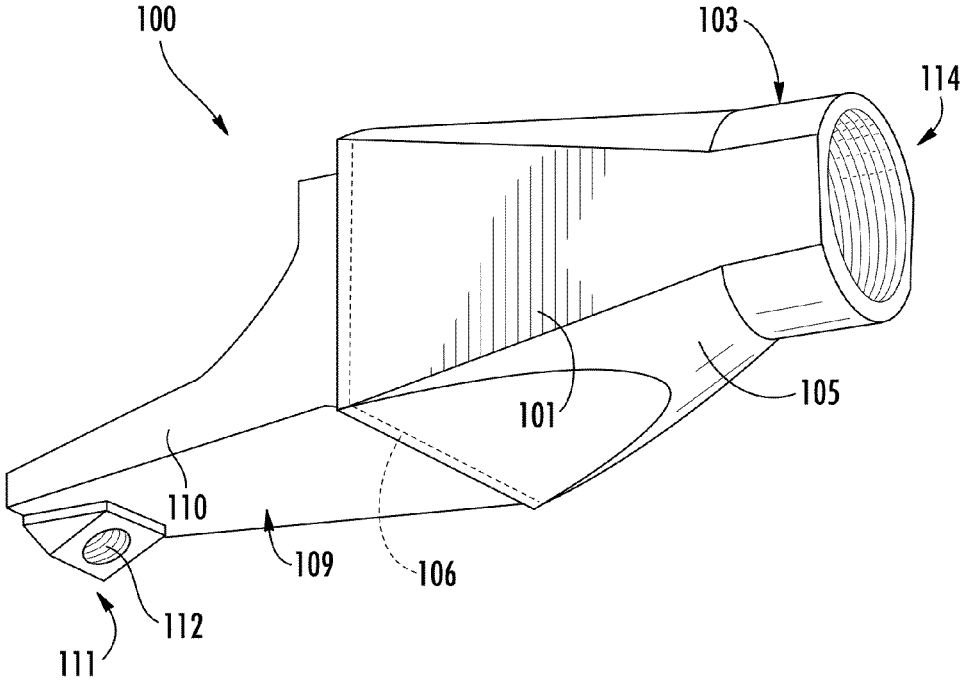
FIG. 2 (FIG. 2) is another perspective view of the internal receiver support according to the claimed invention that fits into and onto the end and inside a standard c-channel type AK rifle receiver.

In a first aspect of the invention, as disclosed below and shown in the appended Figures, there is provided an internal receiver support 100 as shown in FIGS. 1 and 2 that fits into and onto the end and inside a standard c-channel type AK rifle receiver.

Figure 3:
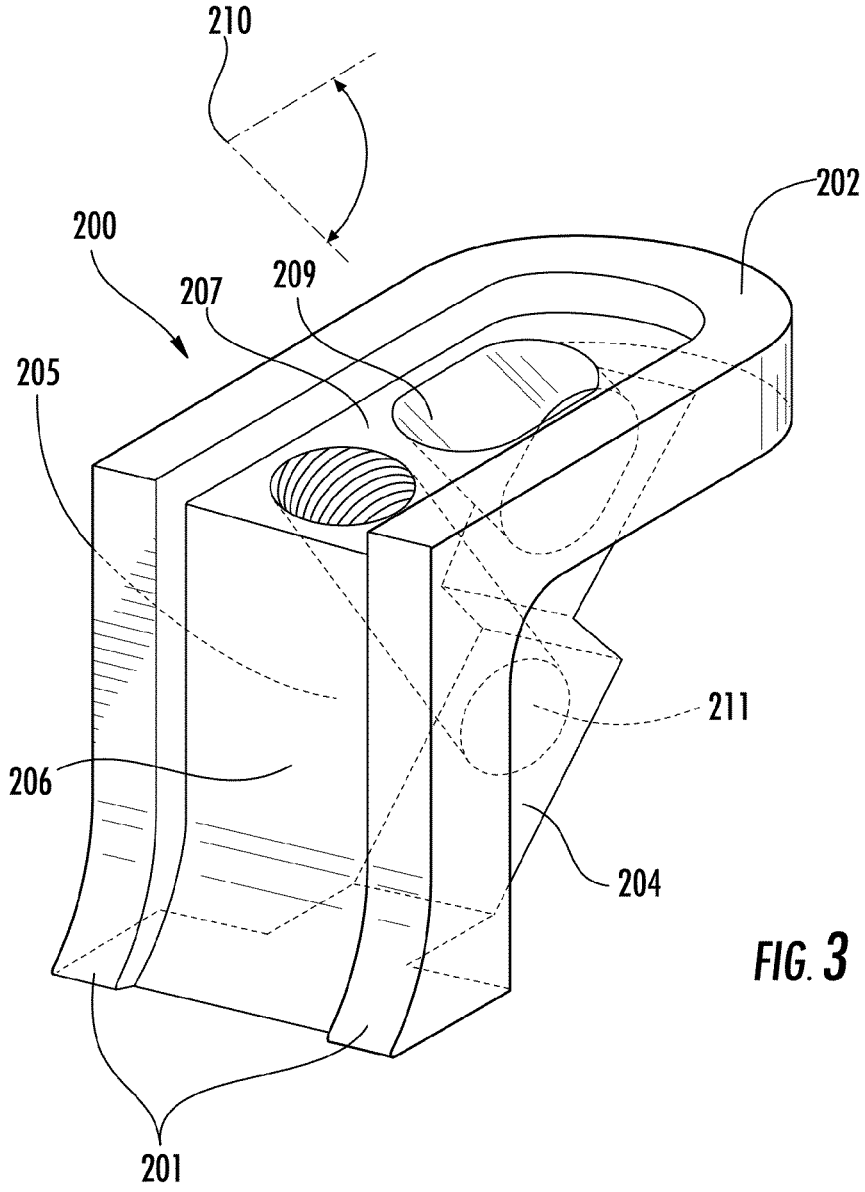
FIG. 3 (FIG. 3) is a perspective view of the external receiver support according to the claimed invention.
Figure 4:
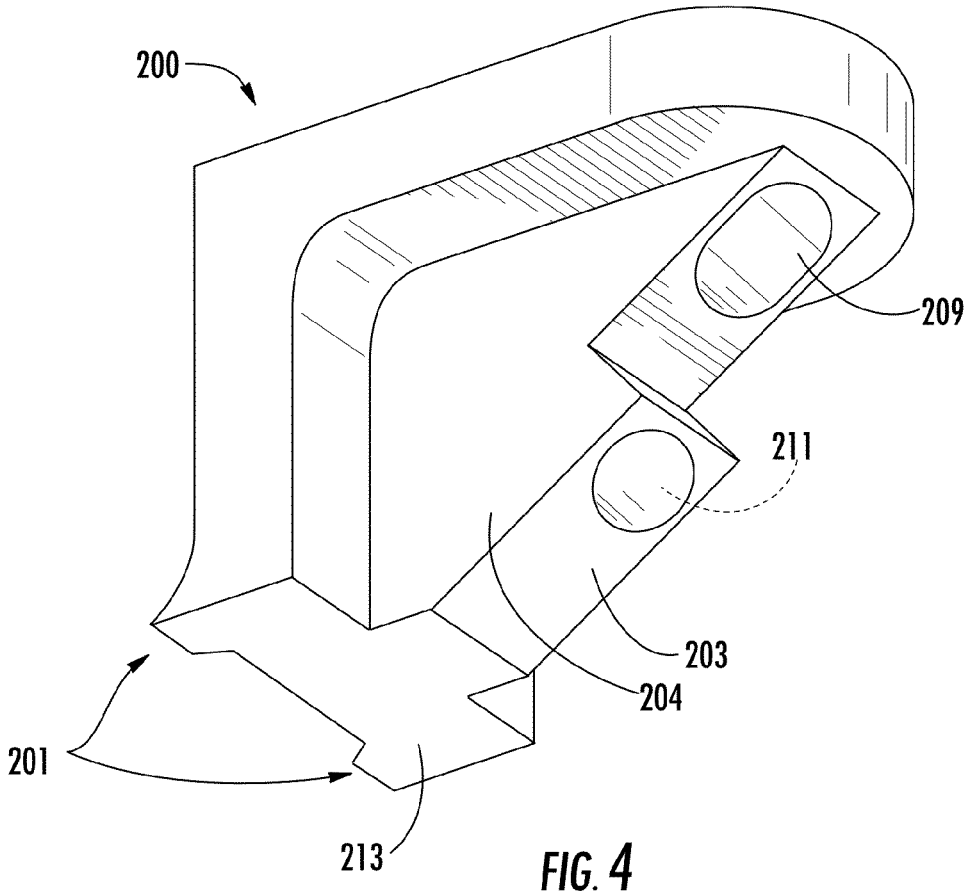
FIG. 4 (FIG. 4) is another perspective view of the external receiver support according to the claimed invention.

In a second aspect of the invention, there is provided an external receiver support in FIGS. 3 and 4, 200 wherein the internal support 100 and the external support 200 are adapted to interconnect.

Figure 5:
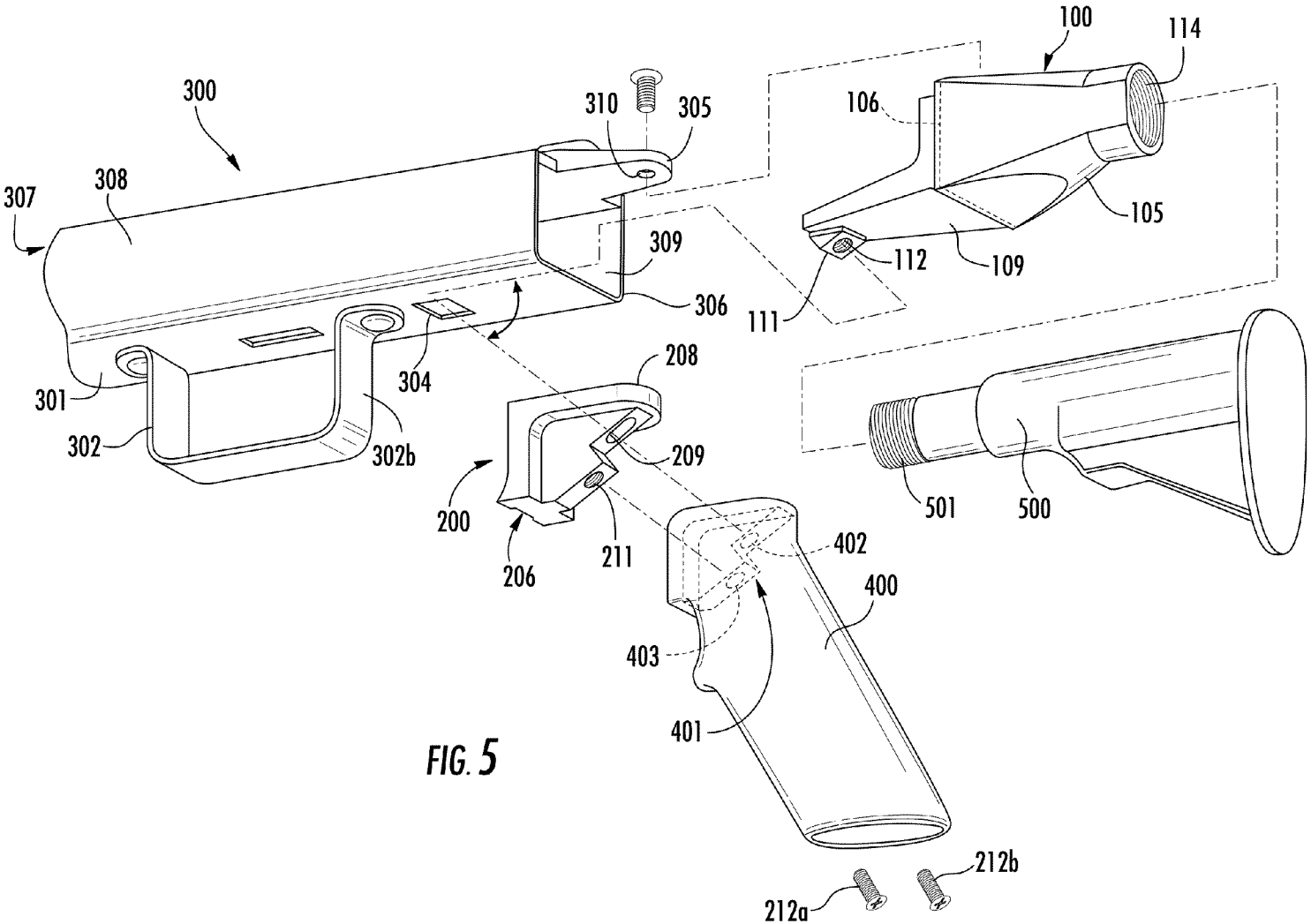
FIG. 5 (FIG. 5) is an exploded view of the components of a rifle/receiver subassembly having a c-channel type receiver including internal and external receiver supports, handgrip portion, trigger guard, and telescopic stock portion according to the claimed invention.
Figure 6:
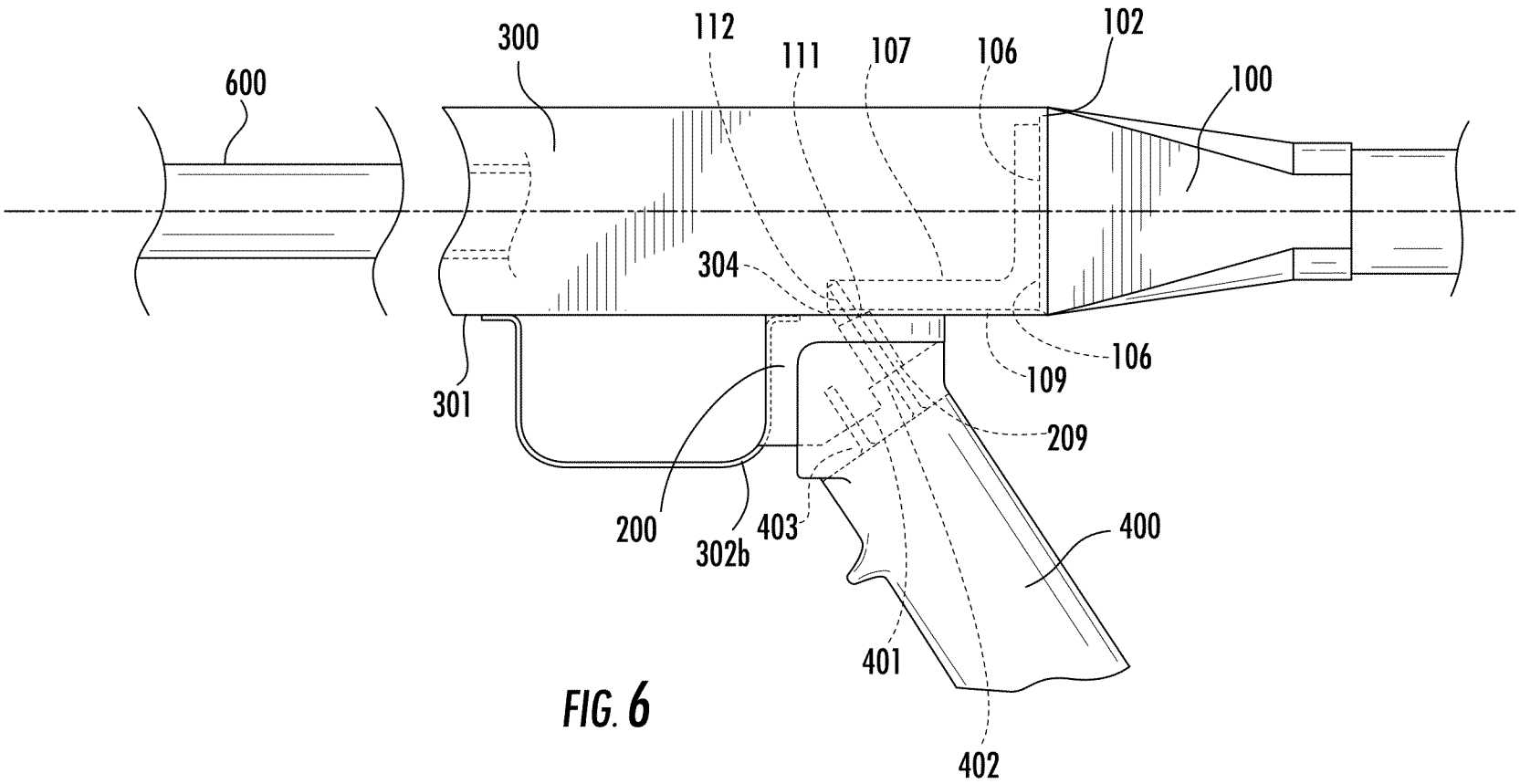
FIG. 6 (FIG. 6) is an x-ray side view of the assembled subassembly component included in FIG. 5: a c-channel type receiver, internal and external receiver supports, barrel portion, trigger guard, grip portion, and stock portion according to the claimed invention.

In a third aspect of the invention, there is provided a rifle sub-assembly according to FIGS. 5 and 6, comprising the internal receiver support, the external receiver support, according to the claimed invention, a conventional c-channel type firearm receiver as previously defined and described.

In a forth aspect of the invention, there is provided a rifle sub-assembly according to FIG. 6, comprising the internal receiver support and external receiver support, according to the claimed invention, and a conventional, c-channel type firearm receiver as previously defined and described, a telescopic rifle stock mounted on the distal end of the internal support, a firearm hand grip mounted onto the external receiver support, a trigger guard mounted on the receiver bottom, and a conventional rifle barrel mounted in a standard configuration in the c-channel type firearm receiver, the barrel and opening in the external receiver being coaxial about the length of the subassembly.

In a fifth and sixth aspect of the invention, there is provided a variation on the first aspect of the invention, as disclosed below, and shown in the appended FIGS. 7 and 8 which are a variation on the internal receiver support as shown in FIGS. 1 and 2 that fits into and onto the end and inside a standard c-channel type AK rifle receiver absent an upper tang portion.

Turning now to the Figures; FIG. 1 and FIG. 2 illustrates an internal receiver support 100 according to the claimed invention that fits into and onto the end and inside a standard c-channel type AK rifle receiver; comprising, a polygonal shaped body 101 with adjacent end 102 for mounting onto one end of and inside a channel type receiver, distal end 103 adaptable for mounting a tubular type firearm stock portion; top 104 and bottom surfaces 105; a recessed shoulder portion 106 is disposed around the body on the adjacent end 102 for abutting to a channel type firearm receiver end (FIGS. 5 and 6), 300), a tongue portion 107 extends from the shoulder at the bottom surface 105, the tongue having upper end 108, lower end 109 and edge portions 110; in practice, the tongue fits securely into the bottom of a receiver. The tongue portion terminates in a rectangular tab portion 111 disposed on the lower tongue surface, the tab and tongue defining a bore 112, wherein the bore axis and the tongue lower surface define an acute angle 113 with vertex at the tab end. In practice, the square tab fits securely into a standard square opening a receiver previously purposed for an adjustable nut that would secure a handgrip onto the c-channel receiver. In practice, the tab is so dimensioned that it is a secure, close, or hand pressed fit into the square opening while the internal receiver support is separable by hand force from the receiver. The distal end 103 further defines an opening 114 adapted to receive a gun stock butt portion. This opening can be positioned vertically on the support, as required, but is preferably positioned so that when mounted in an AK type rifle c-channel receiver, a barrel mounted in the receiver and the opening 114 would be coaxial as viewed end-on. The opening may further comprise a threaded portion, slot and key portion or any other type of mechanical interlock useful with telescopic stock portions as known and practiced in the art. In the most preferred embodiment, a threaded portion 117 as shown in FIG. 4 is provided. Continuing, a slot 115, is disposed in the top surface 104 extending from the shoulder portion 106 toward the distal end, the slot further defining a threaded bore opening 116 extending into the body portion 101. The slot and threaded bore connect to the top tang portion on a conventional AK or channel-type receiver.

Turning now to the FIGS. 3 and 4, there is illustrated the most preferred embodiment of the external receiver support comprising, a substantially prism shaped body portion 200 having first 201, and second 202 substantially perpendicular faces, and a two-stepped third faces 203, two parallel, and recessed sides 204, 205; the first face 201 having a curved groove 206 along the length of the face being adapted for abutting to an trigger guard as used in conjunction with a c-channel type receiver, the second face 202 having a partial groove 207 defined therein, the two grooves intersecting, with the third face 203 being adapted for receiving any conventional firearm hand grip portion; a slot 209 is defined in the body from the stepped third face 203 to the groove in the second face 207, wherein the slot forms an acute angle 210 with the second face, a vertex being toward the first and second faces; and a threaded bore 211 defined in the stepped third face, adjacent to, and below, slot 209 for attaching the hand grip portion. In application, the groove 207 is adapted to receive the tab portion 111 on the internal receiver support 100. Two fasteners 212*a* and 212*b* are used to secure the internal and external supports and grip portion 400 and grip bore 403 through the tab bore 111, 211, and external support slot 209 thereby securely retaining and clamping a standard receiver, without further modifications, between the internal and external supports. The external receiver support terminates in bottom portion 213 which is not particularly limited: it only needs to connect properly to a grip portion.

Turning now to FIG. 5, there is illustrated a preferred firearm subassembly having components of internal support 100, external support 200, mounted on standard channel-type receiver 300, hand grip portion 400, and telescopic stock portion 500. A standard AK-47/channel-type receiver comprises a body portion 300 with a lower portion 301, a trigger guard 302 having a forward portion 302*a*, and a rear portion 302*b*, mounted on the receiver 300 bottom, a trigger 303 conventionally mounted in and through the receiver 300; a square opening 304 is provided behind trigger guard rear 302*b* for receiving the external support 200; the receiver further comprises a top tang portion 305 having a mounting hole 310 defined therein; a rear portion 306 where internal support 100 is reversibly held via shoulder portion 106, the parts being dimensioned so that they are connectable by hand-applied force; forward end 307, and side portions 308 and 309. Stock portion 500 is preferably connected via conventional threaded portion 501 to internal support 100 via threaded opening 114. The subassembly can further comprise the firearm handgrip portion 400, the handgrip having inside surfaces 401 adapted to receive the external receiver support 200, the grip further having an internal support portion 402 defining an axial opening 403 through the upper end of the grip and a fastener 212*a* that connects the grip 400 to the external support 200 through the second bore 211. In another embodiment (not shown), the grip 400 is unitized into a single unit with external receiver support 200.

FIG. 6 illustrates a partial ghost internal view of the assembled subassembly disclosed in FIG. 5, (and FIGS. 1-4) with all components the same save for the addition of a standard barrel portion in a standard position in the c-channel receiver to show the embodiment wherein the distal opening in the internal receiver portion and the barrel portion are assembled in coaxial fashion.

The c-channel receiver and internal receiver support claimed most preferred have shoulder 106 essentially perpendicular to the axis of the c-channel/subassembly. However, this relationship is not necessarily required; some receivers have an angled rear portion and the internal receiver support can be so fabricated to attach to any conventional c-channel/AK-type receiver regardless of rear portion shape and considered to be within the boundary of the claimed invention. The distal end opening 114 can be of any conventional type of connector type other than the most preferred threaded connections as can a corresponding connection fabricated on a stock portion at 501. The fasteners, preferably threaded fasteners 212*a* and 212*b* are preferably conventionally attached through the hollow hand grip portion 400 bottom although this is not required for successful execution of the invention. As most such hand grips are standardized in connection, the external receiver support 200 can be so dimensioned to make use of any type of AK-47 type or AR-15/-16/MP4 or other grip different from the illustrated most preferred design illustrated in the appended Figures. In practicing the claimed invention, the construction materials are not particularly important as long as they are of sufficient strength as one of ordinary skill in the firearm arts would understand to be useful in rifle construction. The parts may be of molded engineering plastics (such as nylons and or fiber reinforced nylons, polycarbonates and the like), metal castings, and machined metal billets such as aluminum or steel, welded, fabricated metals, etc. Machined aluminum is the preferred material for constructing embodiments of the invention.

Figure 7:
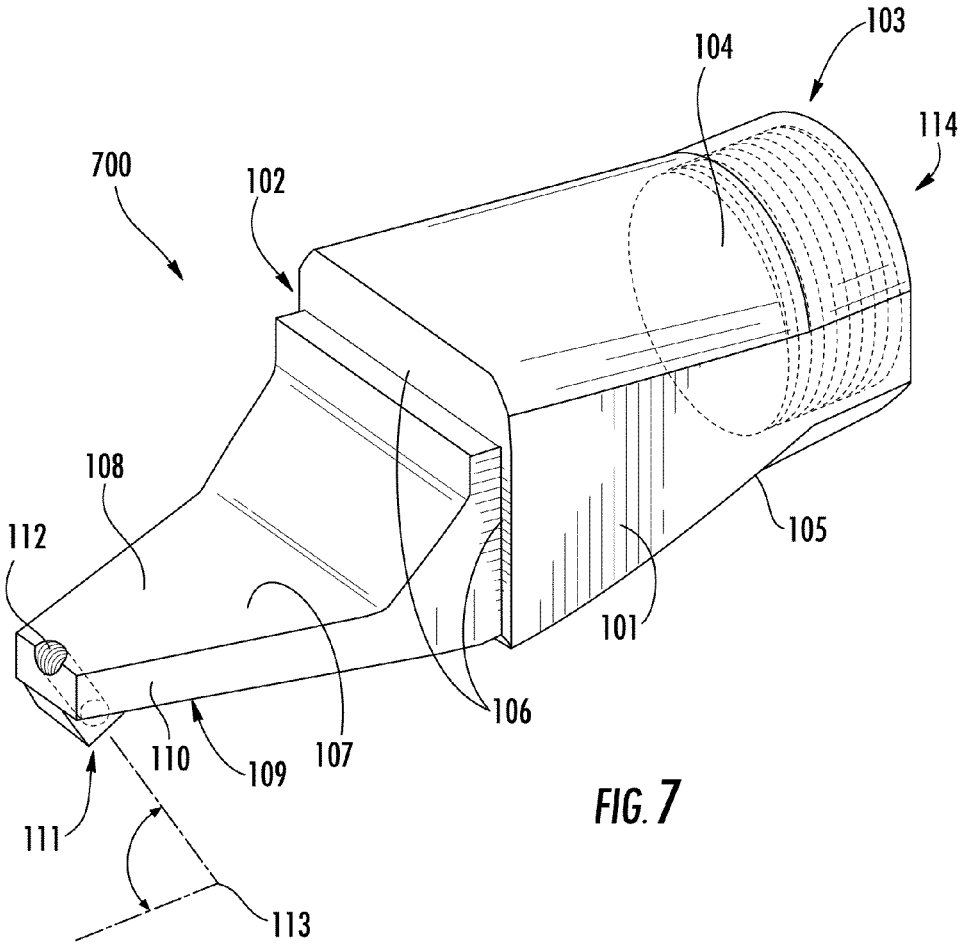
FIG. 7 (FIG. 7) is a perspective view of an alternative embodiment of the internal receiver support, according to the claimed invention, that fits into and onto the end and inside a standard c-channel type AK rifle receiver.
Figure 8:
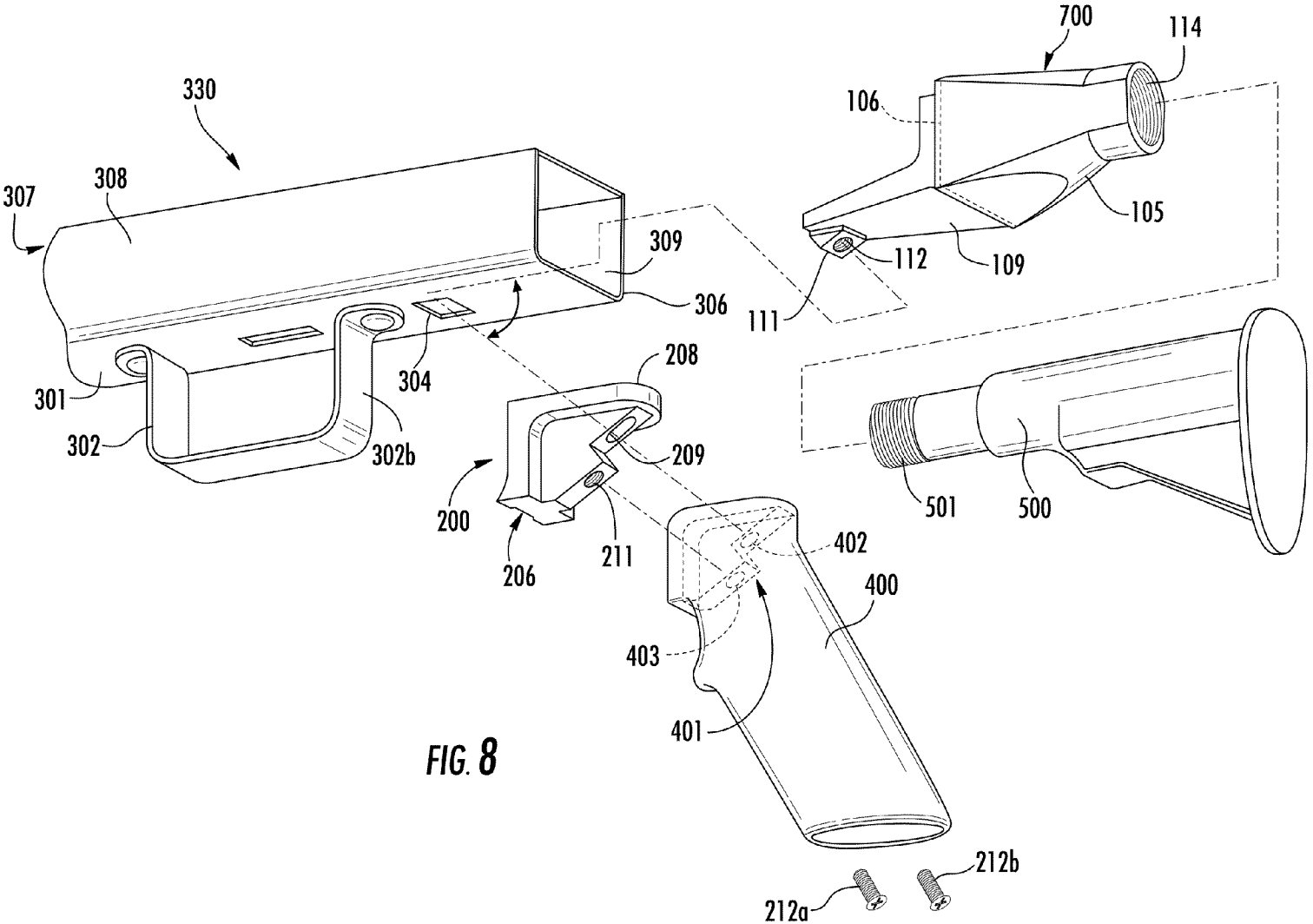
FIG. 8 (FIG. 8) is an exploded view of the components of a rifle/receiver subassembly having a c-channel type receiver that does not include a top tang portion, including internal and external receiver supports, handgrip portion, trigger guard, and telescopic stock portion according to an alternative embodiment of the claimed invention.

FIG. 7 and FIG. 8 illustrate the same basic internal receiver as shown in FIG. 1, 100, but now labeled as 700, according to the claimed invention, that fits into and onto the end and inside a c-channel type AK rifle receiver having a rectangular-end/rear portion terminating in a continuous shell-type end (that is, absent the standard top tang portion for attaching an AK-type drop-stock portion and absent the slot 115, and threaded bore opening 116 extending into the body portion 101.) 700, FIGS. 7 & 8 comprises a polygonal shaped body 101 with adjacent end 102 for mounting onto one end of and inside a channel type receiver, distal end 103 adaptable for mounting a tubular type firearm stock portion; top 104 and bottom surfaces 105; a recessed shoulder portion 106 is disposed around the body on the adjacent end 102 for abutting to a channel type firearm receiver end (FIG. 8), a tongue portion 107 extends from the shoulder at the bottom surface 105, the tongue having upper end 108, lower end 109 and edge portions 110; in practice, the tongue fits securely into the bottom of a receiver. The tongue portion terminates in a rectangular tab portion 111 disposed on the lower tongue surface, the tab and tongue defining a bore 112, wherein the bore axis and the tongue lower surface define an acute angle 113 with vertex at the tab end. In practice, the square tab fits securely into a standard square opening a receiver previously purposed for an adjustable nut that would normally secure a handgrip onto the c-channel receiver. In practice, the tab is so dimensioned that it is a secure, close, or hand pressed fit into the square opening while the internal receiver support is separable by hand force from the receiver. The distal end 103 further defines an opening 114 adapted to receive a gun stock butt portion. This opening can be positioned vertically on the support, as required, but is preferably positioned so that when mounted in an AK type rifle c-channel receiver, a barrel mounted in the receiver and the opening 114 would be coaxial as viewed end-on. The opening may further comprise a threaded portion, slot and key portion or any other type of mechanical interlock useful with telescopic stock portions as known and practiced in the art. In a preferred embodiment, the opening 114 as shown in FIG. 7 is threaded to receive a telescopic stock. The shoulder 106 fits on the c-channel-type receiver end 306 without a tang portion for attaching a stock.

Figure 9:
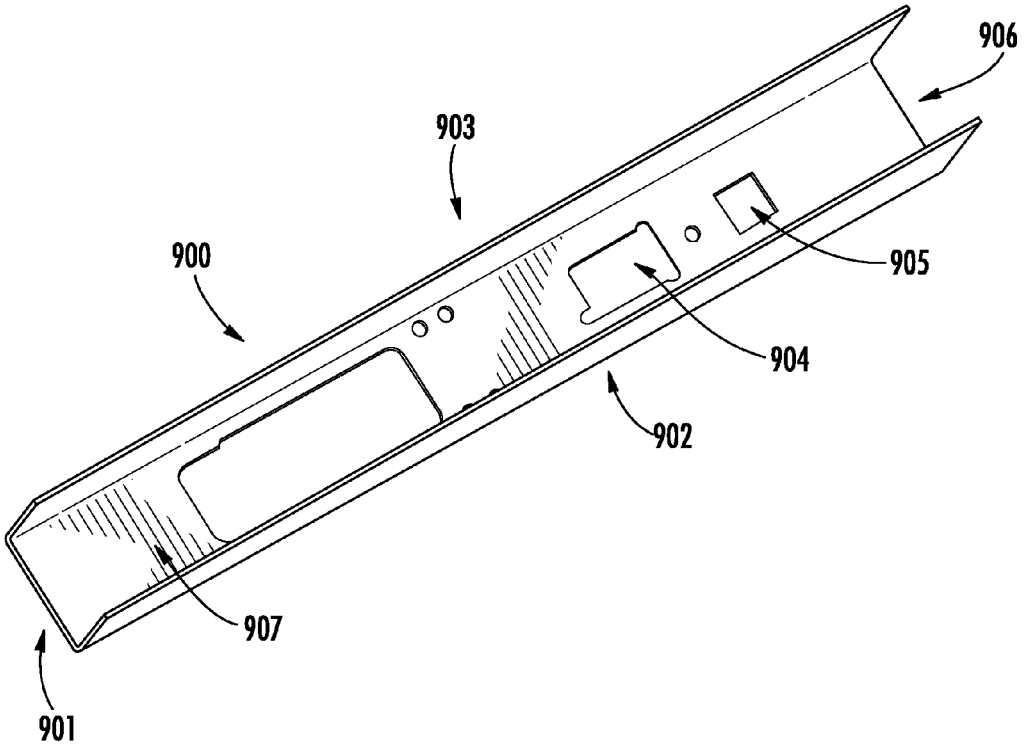
FIG. 9 (FIG. 9) illustrates a generic, basic form of a stamped sheet metal c-channel AK-type receiver useful with the disclosed invention embodiments.

FIG. 9 illustrates a conventional, generic c-channel type sheet metal receiver blank 900 with features well known in the art: with front end 901, sides 902, 903, opening for a trigger and guard attachment 904, and square opening defined behind the opening for a trigger, 905, and rear end of the receiver terminating in a rectangular end 906.

While the invention has been described in connection with what is presently considered to be the most useful and preferred embodiment, it is to be understood that the invention is not to be limited to the disclosed embodiments, but on the contrary, is in tended to cover various modifications and equivalent arrangements included within the sprint and scope of the appended claims.

The claimed invention is:

1. A combination for modifying a c-channel type firearm receiver, comprising:

a) an internal receiver support, comprising a polygonal shaped body with adjacent end; distal end; top surface; and bottom surface; a recessed shoulder portion disposed around the body on the adjacent end; a tongue portion extending from the shoulder at the bottom surface, the tongue having upper end, lower end, and edge portion, the tongue portion terminating in a rectangular tab portion disposed on the tongue lower end, the tab and tongue defining a bore, wherein the bore axis and the tongue lower end define an acute angle; the distal end further defining a cylindrical opening; a slot disposed in the top surface extending from the shoulder portion toward the distal end, the slot further defining a threaded bore opening extending into the polygonal shaped body portion; and b.) an external receiver support comprising a substantially prism shaped body portion having first, and second substantially perpendicular faces, a two-stepped third face, two recessed and parallel sides intersecting the third face; a bottom portion; the first face further having a curved groove along the length of the first face, the second face having a partial groove defined therein, the two grooves intersecting; the third face being adapted for receiving a hand grip portion; a slot defined in the polygonal shaped body from the stepped third face to the groove in the second face wherein the slot forms an acute angle with the second face, the angle having a vertex toward the first and second faces, a threaded bore defined in the stepped third face adjacent to and below the slot for attaching the hand grip portion;

wherein, the internal receiver support and external receiver support are adapted for interconnection.

2. A firearm subassembly, comprising:

a) an internal receiver support, comprising a polygonal shaped body with adjacent end; distal end; top surface; and bottom surface; a recessed shoulder portion disposed around the body on the adjacent end; a tongue portion extending from the shoulder at the bottom surface, the tongue having upper end, lower end, and edge portion, the tongue portion terminating in a rectangular tab portion disposed on the lower tongue surface, the tab and tongue defining a bore, wherein the bore axis and the tongue lower surface define an acute angle; the distal end further defining a cylindrical opening; a slot disposed in the top surface extending from the shoulder portion toward the distal end, the slot further defining a threaded bore opening extending into the body portion; and b.) an external receiver support comprising a substantially prism shaped body portion having first, and second substantially perpendicular faces, a two-stepped third face, two recessed and parallel sides intersecting the third face; a bottom portion; the first face further having a curved groove along the length of the first face, the second face having a partial groove defined therein, the two grooves intersecting; the third face being adapted for receiving a hand grip portion; a slot defined in the polygonal shaped body from the stepped third face to the groove in the second face wherein the slot forms an acute angle with the second face, the angle having a vertex toward the first and second faces, a threaded bore defined in the stepped third face adjacent to and below the slot for attaching the hand grip portion;

wherein, the internal receiver support and external receiver support are adapted for interconnection; and c.) a channel-type firearm receiver; wherein the receiver comprises; a c-channel body portion having a lower portion, first and second side portions, forward and rear portions; a loop trigger guard having a front connecting to the receiver bottom, and a rear connecting to the receiver bottom, a square opening behind the trigger guard; a top tang portion having a hole defined therein;

wherein, the internal receiver support and external receiver support are interconnected through the square opening in the receiver.

3. The combination of claim 2 further comprising a handgrip portion, the handgrip having inside surfaces adapted to connect the grip to the external receiver support with a fastener.

4. The support of claim 2 wherein the distal end opening is adapted to receive a tubular or telescopic gunstock butt-portion.

5. The firearm subassembly of claim 2 wherein the distal end opening is threaded.

6. The firearm subassembly of claim 2, further comprising: a rifle barrel mounted in the receiver, wherein the barrel and the distal end opening in the internal support are co-axial.

7. A firearm subassembly, comprising:

a) an internal receiver support, comprising a polygonal shaped body with adjacent end; distal end; top surface; and bottom surface; a recessed shoulder portion disposed around the body on the adjacent end; a tongue portion extending from the shoulder at the bottom surface, the tongue having upper end, lower end, and edge portion, the tongue portion terminating in a rectangular tab portion disposed on the lower tongue surface, the tab and tongue defining a bore, wherein the bore axis and the tongue lower surface define an acute angle with vertex at the tab end; the distal end further defining a cylindrical opening; and b.) an external receiver support comprising a substantially prism shaped body portion having first, and second substantially perpendicular faces, a two-stepped third face, two recessed and parallel sides intersecting the third face; a bottom portion; the first face further having a curved groove along the length of the first face, the second face having a partial groove defined therein, the two grooves intersecting; the third face being adapted for receiving a hand grip portion; a slot defined in the polygonal shaped body from the stepped third face to the groove in the second face wherein the slot forms an acute angle with the second face, the angle having a vertex toward the first and second faces, a threaded bore defined in the stepped third face adjacent to and below the slot for attaching the hand grip portion;

wherein, the internal receiver support and external receiver support are adapted for interconnection through a c-channel receiver, and c.) the c-channel-type firearm receiver; wherein the receiver comprises; a c-channel body portion having a lower portion, first and second side portions, forward and rear portions, the rear portion terminating in a continuous shell-type end; a loop trigger guard having a front connecting to the receiver bottom, and a rear connecting to the receiver bottom, a square opening behind the trigger guard; wherein, the internal receiver support and external receiver support are interconnected through the square opening in the receiver.

* * * * *